US006896201B1

(12) United States Patent
Ouyoung

(10) Patent No.: US 6,896,201 B1
(45) Date of Patent: May 24, 2005

(54) SHOWER BATH TAP

(75) Inventor: Scott Ouyoung, Taichung (TW)

(73) Assignee: Globe Union Industrial Corp., Taichung (TW)

( * ) Notice: Subject to any disclaimer, the term of this patent is extended or adjusted under 35 U.S.C. 154(b) by 0 days.

(21) Appl. No.: 10/345,264

(22) Filed: Jan. 16, 2003

(51) Int. Cl.[7] ..... B05B 3/04; B05B 1/14; A62C 2/08; A62C 37/08; E21F 5/04

(52) U.S. Cl. ..... 239/240; 239/548; 239/397; 239/444

(58) Field of Search ..... 239/240, 548, 239/397, 444, 550, 551, 562, 563, 565, 225.1, 237, 246, 263, 390, 391, 442, 463, 490

(56) References Cited

U.S. PATENT DOCUMENTS 4,927,083 A * 5/1990 Daunt ..... 239/282
D417,716 S * 12/1999 Warshawsky ..... D23/213
D417,903 S * 12/1999 Warshawsky ..... D23/213
D472,958 S * 4/2003 Ouyoung ..... D23/213

* cited by examiner

*Primary Examiner*—Michael Mar
*Assistant Examiner*—Darren Gorman
(74) *Attorney, Agent, or Firm*—Leong C. Lei

(57) ABSTRACT

A shower bath tap comprised of a seat, an adapter, a circular water outlet tube, a rotation water outlet base, a diversion mechanism, and a depression handle; the adapter being pivoted to water supply lines on the wall and the depression handle being connected to a pivoting rod at the seat to depress the seat; the diversion mechanism being connected to the bottom of the seat; the circular water outlet tube and the rotation water outlet base being respectively connected to the seat; and the diversion mechanism controlling whether the water is to be delivered through the circular water outlet tube or to the rotation water outlet base.

1 Claim, 6 Drawing Sheets

SHOWER BATH TAP

BACKGROUND OF THE INVENTION (a) Field of the Invention

The present invention is related to a shower bath tap, and more particularly, to one that is directly fixed into the wall, having an adaptabled water amount and temperature regulating mechanism and allowing adjustment of its depression.

(b) Description of the Prior Art

The fixed type of shower bath tap generally available in the market delivers water in a one-way, static pattern like a hand-held shower does. However, unlike the hand-held shower, the tap for the fixed type of shower bath prevents the user from bathing his or her body at any angle. Even though the angle of the water delivered can be adjusted in the case of the fixed type of the shower bath tap, it continues to deliver the water statically at the adjusted angle. Consequently, one has to always move his or her body in the direction of the water delivered to allow the entire body to enjoy the shower bath.

SUMMARY OF THE INVENTION

The primary purpose of the present invention is to provide a fixed shower bath tap that allows static or dynamic water delivery as selected by the user. To achieve the purpose, a circular water outlet tube and a rotation water outlet base are provided in conjunction with a water diversion mechanism to promote the utility of the tap to overcome the flaw found with the prior art.

BRIEF DESCRIPTION OF THE DRAWINGS

Referring to FIGS. 1 through 6, a preferred embodiment of the present invention is essentially comprised of a seat 10, an adapter 20, a circular water outlet tube 30, a rotation water outlet base 40, a diversion mechanism 50 and a depression handle 60. The seat 10 contains a primary passage 101 and a secondary passage 102 with a diameter smaller than that of the primary passage. The primary passage 101 has a threaded opening at its bottom and connects through at its top to the secondary passage 102 as illustrated in FIG. 5. The diversion mechanism 50 is placed at the opening of the primary passage. A connection tube 11 connecting a hollow duct 111 is fixed at the very top of the seat 10 and the hollow duct 111 is connected through the secondary passage 102. Another end of the connection tube 11 is fixed with a cylindrical receptor 12 having a trapezoid trough 121 and an opening at the bottom. The receptor 12 in conjunction with a passive rotation mechanism 14 is pivoted to the rotation water outlet base 40. A connection opening 103 connected through to the primary passage 101 is provided on both sides of the seat 10, and the circular water outlet tube 30 is connected to the connection opening 103. Multiple pores 301 to deliver water are provided on the bottom of the circular water outlet tube 30.

Figure 1:
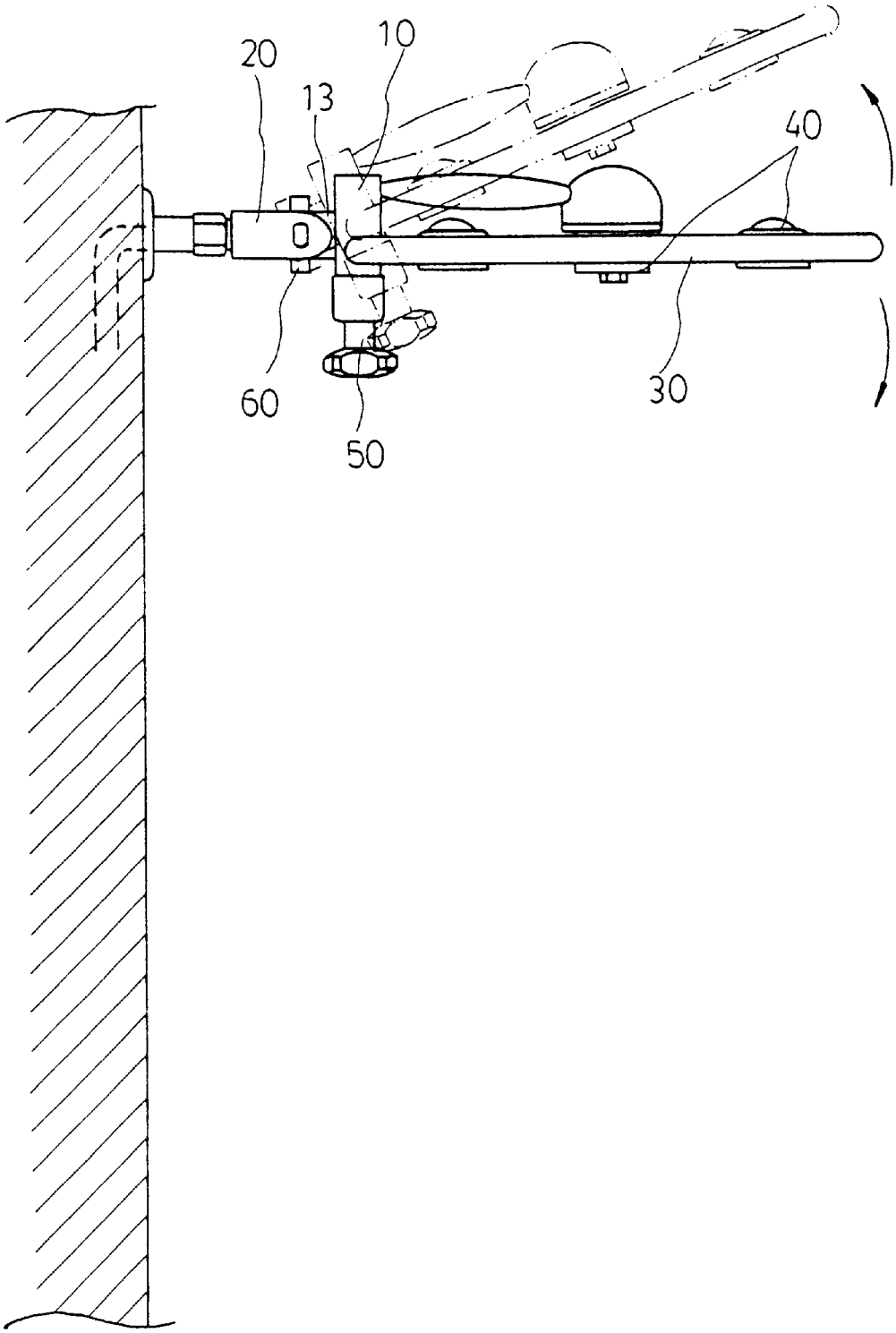
FIG. 1 is a schematic view showing a configuration of a preferred embodiment of the present invention.
Figure 2:
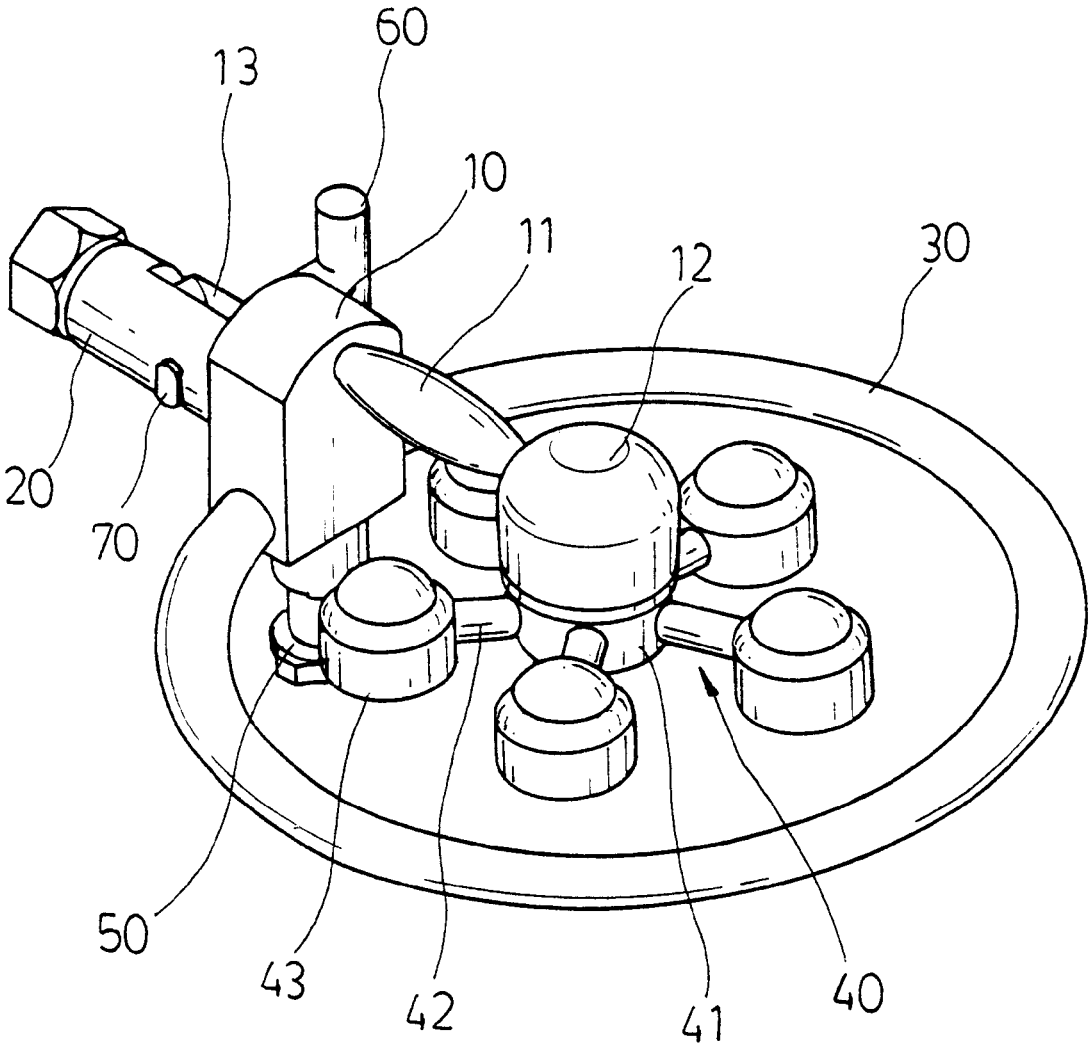
FIG. 2 is a perspective view of the preferred embodiment of the present invention.
Figure 3:
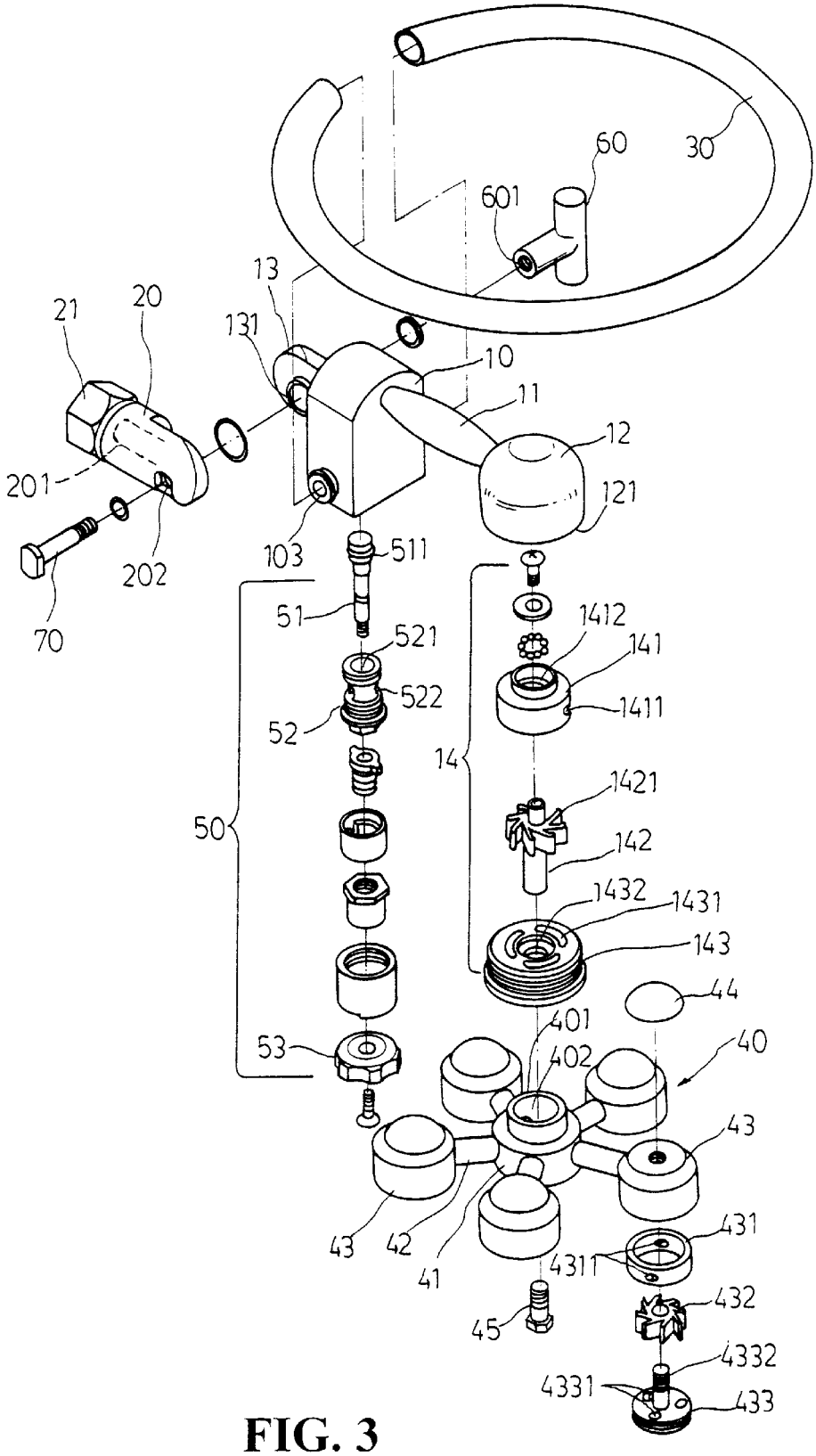
FIG. 3 is an exploded view of the preferred embodiment of the present invention.
Figure 4:
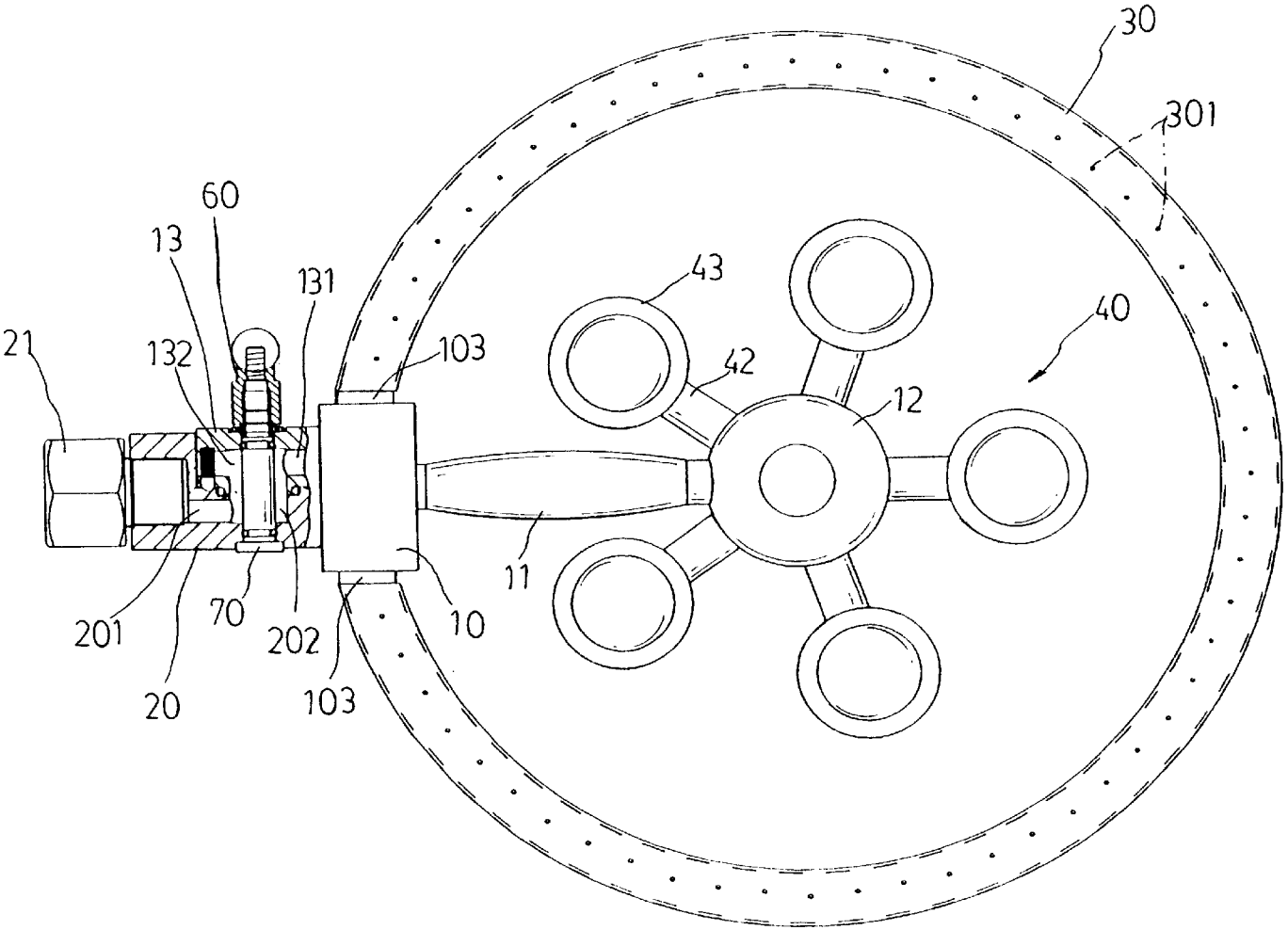
FIG. 4 is a bird's view of the preferred embodiment of the present invention.

A semi-cylindrical pivoting rod 13 fixed to the back of the seat 10 contains a water guide passage 131 connected through the primary passage 101 of the seat 10 while a water inlet pore 132 connected through the water guide passage 131 is provided between both surfaces inside the pivoting rod 13. The adapter 20 in a cylindrical rod shape has pivoted at its end a nut 21 that freely rotates to be connected to water supply lines on the wall; and at its end a semi-cylindrical rod in relation to the pivoting rod 13 is fixed to the seat 10. A water inlet passage 201 is inwardly provided where the nut 21 is pivoted to the adapter 20. A water guide pore 202 connected through the water inlet passage 201 is provided penetrating the surface of the semi-cylindrical rod of the adapter 20. The surface of the semi-cylindrical rod of the adapter 20 is flushed with that of the pivoting rod 13 of the seat 10. A bolt 70 is inserted through the water guide pore 202 and the water inlet pore 132 to engage a screwed hole 601 of the depression handle 60. Consequently, the adapter 20 is connected to the pivoting rod 13 of the seat 10 for the depression handle 60 to control the tension of the connection between the adapter 20 and the pivoting rod 13.

The rotation water outlet base 40 is comprised of a body 41 fixed with multiple water guide tubes 42 each adapted with a water outlet head 43. A flange 401 and a central trough 402 are provided on top of the body 41, and a connection bole 403 in diameter smaller than that of the central trough 402 is provided at the bottom of the body 41. The terminal of each water guide tube 42 is fixed with the water outlet head 43 in a cylindrical shape having an open bottom trough 430. Both ends of the water guide tube 42 respectively connect through the central trough 402 and the trough 430 of the water outlet head 43. A circular channel 4301 is provided on the inner wall of each trough 430 of the water outlet head 43, and a circular hole is provided at the top of each water outlet head 43. A packing retainer ring 431 provided with multiple inclined holes 4311 is inserted into the trough 430. A cover 433 having at its center a connection rod 4332 is provided at the bottom of the water outlet head 43, and multiple water outlets 4331 are provided on the cover 433. The connection rod 4332 is inserted with a water wheel 432 and placed in the trough 430 with the connection rod 4332 to penetrate through the circular hole at the top of the water outlet head 43 to be screwed to an upper cover 44. The rotation water outlet base 40 adapted with the passive rotation mechanism 14 is connected to the receptor 12 of the seat 10.

The passive rotation mechanism 14 includes a packing retainer 141, a rotation rod 142, and a water guide seat 143, wherein the packing retainer 141 has provided on the opposite circumferential sides two inclined holes 1411; and on its top a flange with an axial hole 1412 to accommodate a bearing and to permit the top of the rotation rod 142 to penetrate before being locked with a screw. Multiple blades 1421 are provided close to the top of the rotation rod 142 with both ends of the rotation rod 142 each having a screwed hole. The top of the rotation rod 142 penetrating through the axial hole 1412 at the top of the packing retainer 141 and is adapted with a bearing and a washer before being secured with a screw. Those blades 1421 are received inside the packing retainer 141, and the lower end of the packing retainer 141 penetrates through the central axial hole 1432 of the water guide seat 143 and is adapted with a bearing. The rotation rod 142 exercises free rotation by both of the upper and the lower bearings. Multiple water guide holes 1431 are provided on the water guide seat 143, and the side of the peripheral of the water guide seat 143 is threaded so as to lock up the entire passive rotation mechanism 14 to a point between the trough 121 in the receptor 12, thus to rotate the water outlet base 40 for the flange 401 at the top of the body 41 and enabling it to be placed inside the connection trough 1433 provided at the bottom of the water guide seat 143 of the passive rotation mechanism 14. Meanwhile, the lower end of the rotation rod 142 is placed in its connection hole 403 before being secured with a bolt 45.

The diversion mechanism 50 provided at the bottom of the primary passage 101 of the seat 10 is essentially comprised of a spindle 51, a water guide 52, and a knob 53, wherein the diameter of a plug 511 provided at the top of the spindle 51 is greater than the bore of the secondary passage 102 of the seat 10. Inside the water guide 52, a water guide channel 521 in the larger bore and an axial hole 522 in the smaller bore are provided while multiple water pores 5211 are provided on the wall of the water guide channel 521. The lower part of the water guide 52 is threaded to be screwed to the primary passage 101. The spindle 51 is inserted into the water guide 52 and penetrates through the axial bole 522 to be connected to the knob 53 and fixed with a screw. Multiple passive accessories are provided between the knob 53 and the water guide 52 and are not described here since they are variable and involve practices generally known to those who are familiar with this art.

Figure 5:
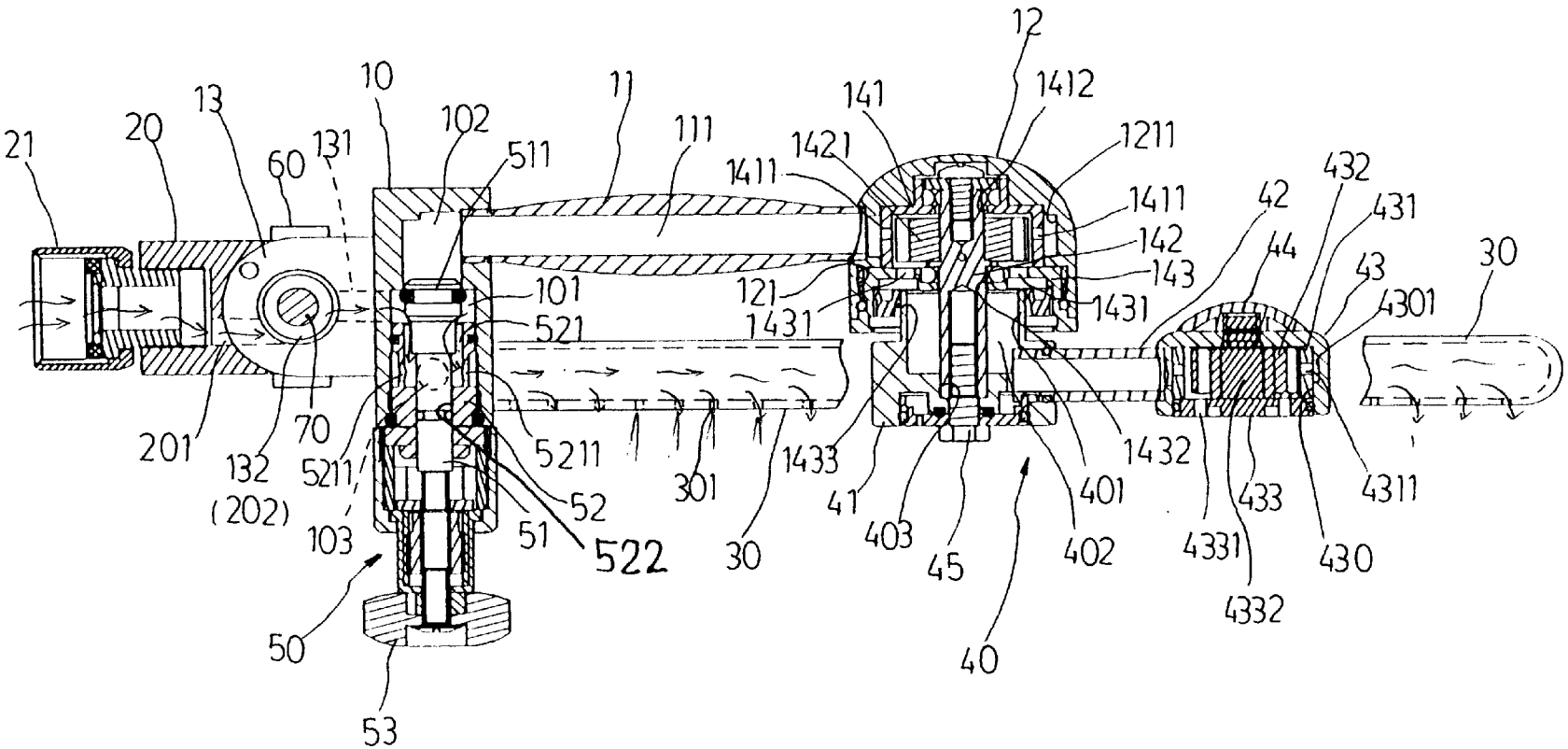
FIG. 5 is a schematic view showing the operation of the preferred embodiment of the present invention.
Figure 6:
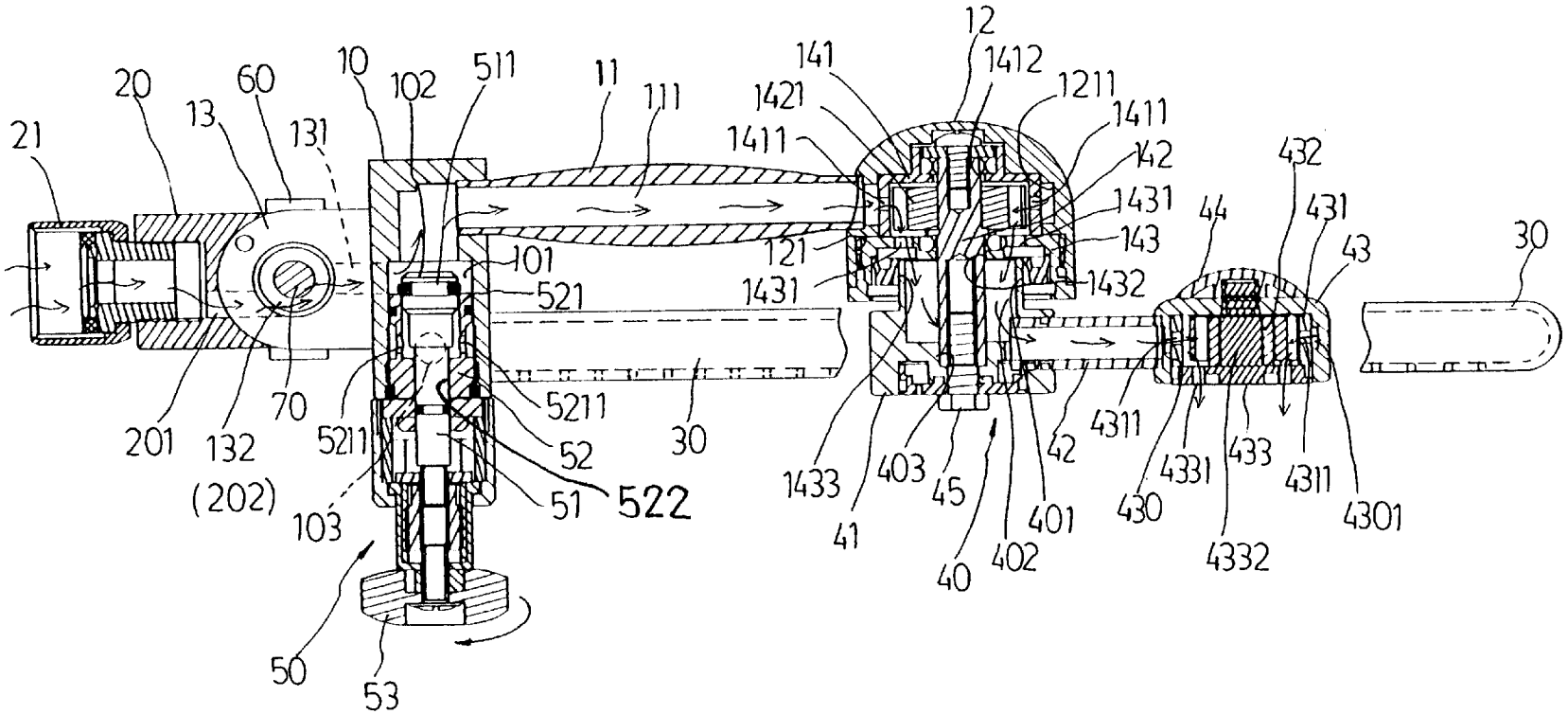
FIG. 6 is another schematic view showing the operation of the preferred embodiment of the present invention.

FIGS. 5 and 6 show the operation of the present invention. As illustrated in FIG. 5, the knob 53 of the rotation diverting mechanism 50 is turned so as to make the spindle 51 move up to the plug 511 so as to close up the entrance to the secondary passage 102 in the seat 10. The water flows from the water inlet passage 201 of the adapter 20 through the water guide passage 131 into the primary passage 101 of the seat 10 Since the secondary passage 102 is closed and the water guide channel 521 of the water guide 52 is in open status, the water is admitted to flow into the water guide channel 521, through the water outlet pores 5211 and the connection opening 103, into the circular water outlet tube 30 and is sprayed in minute jets out of those pores 301 distributed on the bottom of the circular water outlet tube 30.

Now referring to FIG. 6, the knob 53 of the diversion mechanism 50 is turned to move the spindle 51 down to the plug 5 11 so as to close up the entrance to the water guide channel 521 of the water guide 52 and to leave open the secondary passage 102. Accordingly, the water in the primary passage 10 flows from the secondary passage 102 through the hollow duct 111 of the connection tube 11 into the receptor 12. At the same time, the water flows into those two inclined holes 1411 opposite to each other on the packing retainer 141 from a circular channel 1211 provided in the trapezoid trough 121 of the receptor 12. The water flowing through those two inclined holes 1411 is intensified to become a strong current and enter into the packing retainer 141 in the direction of a tangent to flush those blades 1421. Driven by those blades 1421, the rotation rod 142 rotates to further drive the water outlet base 40 to rotate while the flushing water flows downwards to pass each of those water guide holes 1431 of the water guide seat 143 into the central trough 402 of the body 41 of the rotation water outlet base 40 before being diverted into each water guide tube 42. The water from the water guide tube 42 flows towards the trough 430 of the water outlet head 43 to pass through the circular channel 4301 to simultaneously flow into those two inclined holes 4311 on the packing retainer ring 431. The water passing through those two inclined holes 4311 becomes a strong current and enters in the direction of a tangent into the packing retainer ring 431 to flush and rotate the water wheel 432, thus to spray from the water outlet of the cover 433 at the bottom. While the rotation water outlet base 40 rotates together with multiple identical water outlet heads 43, the tap delivers a full-scale, dynamic spray.

I claim:

1. A shower bath tap comprising a seat, an adapter, a circular water outlet tube, a passive rotation mechanism, a rotation water outlet base, a diversion mechanism, and a depression handle, wherein the seat includes a primary passage and a secondary passage with a diameter larger than a diameter of the primary passage, an opening provided at a bottom of the primary passage to connect the diversion mechanism, a connection tube connecting through the secondary passage being fixed at a top of the seat, the connection tube connecting a cylindrical receptor provided with a trapezoid trough facing downward, the cylindrical receptor containing the passive rotation mechanism to pivot the rotation water outlet base; an opening connecting through the primary passage being provided on both sides of the seat and fixed to both ends of the circular water outlet tube, a semi-cylindrical pivoting rod being provided at a back of the seat to joint the adapter and having a water guide passage connecting through the primary passage, and a water guide hole penetrating and connecting through the water guide passage being provided on a surface of the semi-cylindrical pivoting rod, the adapter having its terminal pivoted to a free rotation connection nut, and another end cut into a semi-cylindrical shaped rod in corresponding relation to the semi-cylindrical pivoting rod, a water inlet passage being provided in the adapter with one end connected to the opening at the nut, a water guide pore being provided by penetrating a surface of the semi-cylindrical rod of the adapter and connecting through the water inlet passage, a surface of the semi-cylindrical rod resting on a surface of the semi-cylindrical pivoting rod, both water guide pores being connected before being inserted with a bolt to be screwed to the depression handle; the circular water outlet tube is a hollow tube, both ends of the tube being respectively fixed to the two openings provided on both sides of the seat, and multiple pores being provided on a bottom edge of the tube; the passive rotation mechanism including a packing retainer, a rotation rod, and a water guide seat, the packing retainer having a top provided with a flange, a central axial hole and two inclined holes on its opposite circumferential sides, the rotation rod having multiple blades, and the water guide seat having multiple water guide pores, a central axial hole, and a threaded circumferential side, a top of the rotation rod penetrating through the axial hole of the packing retainer, the blades of the rotation rod being accommodated inside the packing retainer, a lower end of the rotation rod penetrating through the axial hole in the water guide seat, and the passive rotation mechanism being screwed into the trapezoid trough of the cylindrical receptor; the rotation water outlet base having a flange provided at its top and a central trough having an open top, a bottom of the central trough being provided with a body having a connection hole and multiple water guide tubes being fixed to a circumferential side of the flange, one end of each water guide tube being connected through the central trough and the other end thereof being fixed with a water outlet head; each water outlet head having an open bottom trough and a circular hole at its top, a packing retainer ring having two inclined holes opposite to each other on its circumferential side being provided inside the open bottom trough, a cover having multiple water outlet pores on its surface and a connection rod at its center, the connection rod being inserted into a water wheel, and a top of the connection rod penetrating through the circular hole at the top of each water outlet head to be screwed and secured to an upper cover; the diversion mechanism including a spindle having a plug provided at its top with a diameter greater than a bore of the secondary passage of the seat, a water guide channel provided with an open end and multiple water outlet pores on its wall, the water guide channel having an axial hole being provided on its bottom, and a knob, the spindle being inserted into the water guide channel with a lower part of the spindle penetrating through the axial hole of the water guide channel, the spindle being adapted with a screw to be engaged to the knob, the water guide channel being placed in a lower part of the primary passage of the seat, and a plug of the spindle being placed between the secondary passage and an opening of the water guide channel for displacement by rotation.

* * * * *